United States Patent [19]

Booth

[11] Patent Number: 4,863,024

[45] Date of Patent: Sep. 5, 1989

[54] COLLAPSIBLE PALLET AND RELATED PRODUCTS

[76] Inventor: Clarence R. Booth, R.D. 3, Box 384, Milford, N.J. 08848

[21] Appl. No.: 230,512

[22] Filed: Aug. 10, 1988

[51] Int. Cl.[4] ..... B65D 19/06

[52] U.S. Cl. ..... 206/386; 206/600; 108/51.3; 108/56.3

[58] Field of Search ..... 206/386, 395–600; 108/51.1, 51.3, 52.1, 53.1, 53.3, 53.5, 54.1, 55.1, 55.3, 55.5, 56.1, 56.3, 57.1

[56] References Cited

U.S. PATENT DOCUMENTS

| | | | |
|---|---|---|---|
| 2,444,183 | 6/1948 | Cahners . | |
| 2,494,730 | 1/1950 | Thursby . | |
| 2,904,297 | 9/1959 | Hamilton | 108/51.3 |
| 3,026,153 | 3/1962 | Severn | 108/55.1 |
| 3,308,772 | 3/1967 | Thomas, Jr. . | |
| 3,626,860 | 12/1971 | Blatt | 108/51.3 |
| 4,091,923 | 5/1978 | Collins | 206/386 |
| 4,185,565 | 1/1980 | Nymoen | 108/51.3 |
| 4,378,743 | 4/1983 | McFarland | 108/51.3 |
| 4,424,753 | 1/1984 | Eatherton | 108/56.1 X |

FOREIGN PATENT DOCUMENTS

| | | | |
|---|---|---|---|
| 248783 | 1/1964 | Australia | 108/51.3 |
| 2321432 | 2/1977 | France | 206/599 |
| 2606370 | 5/1988 | France | 206/386 |
| 1503507 | 3/1978 | United Kingdom | 206/600 |
| 197808 | 8/1978 | United Kingdom | 206/599 |
| 2193191 | 2/1988 | United Kingdom | 206/386 |

*Primary Examiner*—William Price

*Attorney, Agent, or Firm*—Kenneth P. Glynn

[57] ABSTRACT

The present invention is directed to pallets and related products, i.e. containers including the present invention pallets, which are made of elongated continuous sheet base material which includes side edges which are folded downwardly, inwardly, upwardly and again inwardly to form U-type channels. Inserted into these channels are channel supports which act to internally fortify the supporting capabilities of the channels and maybe corrugated cardboard, urethane foam, honeycomb structure of synthetic materials or the like. Both the channel supports and the channels have slots or cutouts through which a plurality of beams are passed at right angles to the channels. These beams not only fit snugly through the channels and the channel supports, but also press against the underside of the base to increase the structural capabilities of the invention. In an alternative embodiment, containers have extended walls which are folded inwardly, upwardly and then inwardly again to create the channels and the aforementioned channel supports and beams are applied concomitantly.

30 Claims, 4 Drawing Sheets

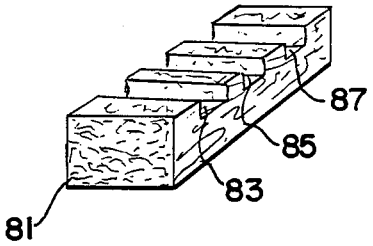
FIG. 5
FIG. 6
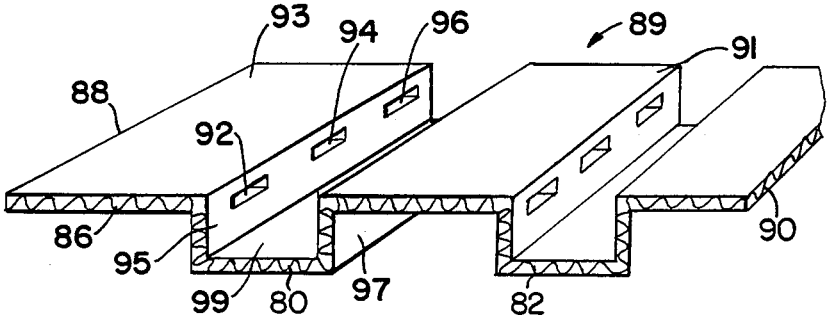
FIG. 7
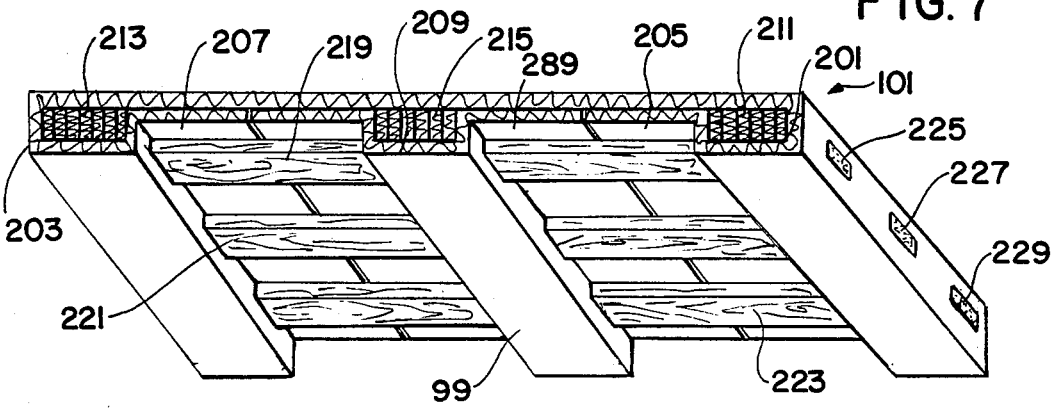
FIG. 8
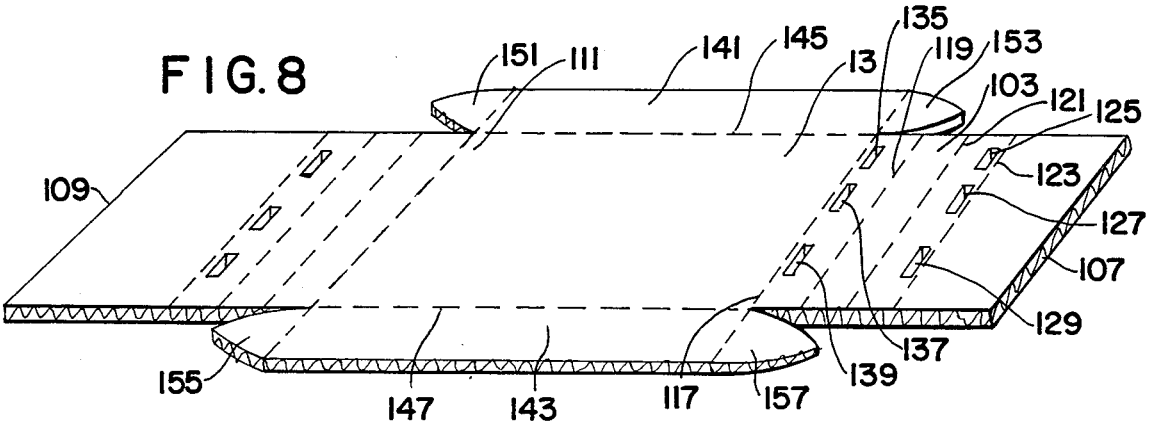

COLLAPSIBLE PALLET AND RELATED PRODUCTS

BACKGROUND OF THE INVENTION

1. Field of the Invention

The present invention relates to a collapsible pallet and related products and more specifically relates to a unique pallet which is formed from folded sheet material whereby pallet channels are established. Supporting inserts are included in the pallet channels and spanning beams are passed through slots at right angles to the channels to enhance the structural support. The related products include pallets with walls extending upward to form containers such as boxes and trays as well as containers wherein the walls extend downwardly and are folded in a predescribed fashion to create channels of the type set forth in the present invention.

2. Prior Art Statement

Pallets have been used for many years for supporting boxes, crates, barrels and other types of packaging for stacked transport and have typically been constructed of wooden lattice arrangments involving parallel boards mounted horizontally on vertical slats or runners at right angles thereto. Over the past few years, developments have been made to create substitutes or partial substitutes for wood in the construction of pallets. This led to not only changes in the construction materials, but also to modifications in the actual pallet designs themselves. While the prior art is replete with teachings which show many variations on the pallet, including cardboard pallets with some types of folds or supports, to date, no prior art teaching has set forth the particular advantages or particular design of the present invention. The following prior art patents are representative of the pallet and palletized container art:

U.S. Pat. No. 2,944,296 to J. P. Hamilton, describes a pallet consisting of a plurality of channels which are made from folded cardboard or the like and which include wooden slats inserted through slots to create the basic pallet lattice structure. However, the Hamilton type pallet is made of independent channels which are somewhat free floating relative to one another, are not prealigned with respect to the distances between each of the channels nor are they necessarily assured of being kept in parallel. Additionally, when the Hamilton type pallet is in use, it is possible for movement of the channels relative to one another whereby some risk might be created regarding weight loads at the ends of the flats where the channel may have been accidently or through movement pushed under the weight and tipping may occur. Thus, the Hamilton pallet substantially reduces the amount of wood involved but increases the complexity of the arrangement and, more significantly, creates risks which are not inherent in the nailed pallet design which is conventionally used.

U.S. Pat. No. 2,444,183 to Cahners describes a fiber board portable platform which includes the formation of channels from folded cardboard and their interlocked relationship including the use of cross members to enhance support, which cross members are located within the channels themselves. While the fiberboard platform of Cahners does allow for formation out of fiberboard without the need for any nailing, there are channels formed in one direction and no support members at right angles thereto other than the flat cardboard surfaces. Thus, in a Cahners type fiberboard portable platform, if the weight load is shifted onto, for example, two out of three of the channels, when the pallet itself is lifted as with a forklift or is otherwise moved, there is a high likelihood that the cardboard flat surface will fold and the structural integrety of the platform itself will be permanently damaged.

U.S. Pat. No. 4,378,743 to McFarland described a paperboard pallet having interlocked runners. However, this pallet is more like a tray wherein the runners are inserted into the bottom, i.e. are located above and not below the basic horizontal surface and are inserted by the use of blocks located at the bottom of the channels. However, as with the prior art described above, the runners are all in a single direction and only the tray cardboard sidewalls provide for structural support at right angles to the runners. Additionally, the McFarland type pallet runs the risk of forklift motion or other motion actually popping the blocks up through the base and therefore destroying the integrety of the structure itself. Additionally, a folding may occur at points parallel to the runners should the weight be shifted and movement be made in such a manner that force is applied to the pallet areas where there is no significant weight.

U.S. Pat. No. 3,308,772 describes a disposal pallet having channels located on the underside which are basically U-shaped channels formed of sheet material. Again, this type of pallet does not allow for significant structural support at right angles to the parallel channel. Additionally, the pallet channels themselves are hollow and may be subjected to weight which would cause flattening and therefore destruction of the basic integrity of the pallet itself.

U.S. Pat. No. 4,185,565 to Nymoen again describes sheet material type pallets having a base with parallel channels on the underside. In this case, the parallel channels are initially formed by a series of folds from a single undersheet and these are then interlocked with hollow channels formed at the ends of a second base sheet. The result is a pallet which has channels which are hollow but with closed ends. Both the flattening problems as well as the problems of bending at points between the channels are problematic with this type of design.

U.S. Pat. No. 4,091,923 is directed to a combined carton and supporting pallet. This particular design involves a typical cardboard box which has a synthetic pallet with a base in the flap and the flap is simply tucked into the folding flaps of a typical box and then the base is dropped over it. The box is then trned over and rests on sections or channels which are attached to the bottom of the base. This particular type of pallet does not include any structural support at right angles to the runners located on the bottom but is only structurally significant when it is located in place in a particular carton for which it is designed to fit. In other words, the pallet described in this patent is unique to a particular size carton but yet is not an integral part thereof and must be inserted into the carton. If the pallet of this patent is used without being inserted into a carton, it has even less structural integrety than all of the other pallets cited above due to the fact that one of the two top layers would be a free floating flap and the fact that there would be no structural support other than the single piece of cardboard which would bind the runners, at right angles to the runners.

U.S. Pat. No. 2,494,730 to Thursby describes palletized containers which rely upon folded cardboard channels and inserts but again lack any additional structural support other than the cardboard at right angles to the channels.

Thus, the prior art describes many variations on cardboard type pallets and related products but fails to describe any system wherein the channels may be integrally formed from the sheet material base and which include supporting inserts into the channels as well as cross beams located against the underside of the base itself. In other words, the present invention pallets have channels which are supported internally by structural inserts and the channels as well as the base are further structurally supported by beams which run at right angles to the channels, pass through slots in the channels themselves and are pressed against the underside of the base to create significant structural advantages.

SUMMARY OF THE INVENTION

The present invention is directed to pallets and related products, i.e. containers including the present invention pallets, which are made of elongated continous sheet base material which includes side edges which are folded downwardly, inwardly, upwardly and again inwardly to form U-type channels. Inserted into these channels are channel supports which act to internally fortify the supporting capabilities of the channels and maybe corrugated cardboard, urethane foam, honeycomb structure of synthetic materials or the like. Both the channel supports and the channels have slots or cutouts through which a plurality of beams are passed at right angles to the channels. These beams not only fit snugly through the channels and the channel supports, but also press against the underside of the base to increase the structural capabilities of the invention. In an alternative embodiment, containers have extended walls which are folded inwardly, upwardly and then inwardly again to create the channels and the aforementioned channel supports and beams are applied concomitantly.

BRIEF DESCRIPTION OF THE DRAWINGS

The present invention is more fully understood when taken in conjunction with the accompanying figures, wherein:

FIG. 5 illustrates an alternative channel insert made of foam;

FIG. 6 shows a top oblique view of a supplemental base which may be inserted on the underside of and used in conjunction with the pallets and containers of the present invention;

FIG. 7 shows an expanded width pallet of the present invention which includes a supplemental base of the type shown in FIG. 6 in actual use;

FIG. 8 shows a trap pallet combination blank continuous sheet which is cut, scored and slotted;

DETAILED DESCRIPTION OF THE PRESENT INVENTION AND DRAWINGS

Figure 1:
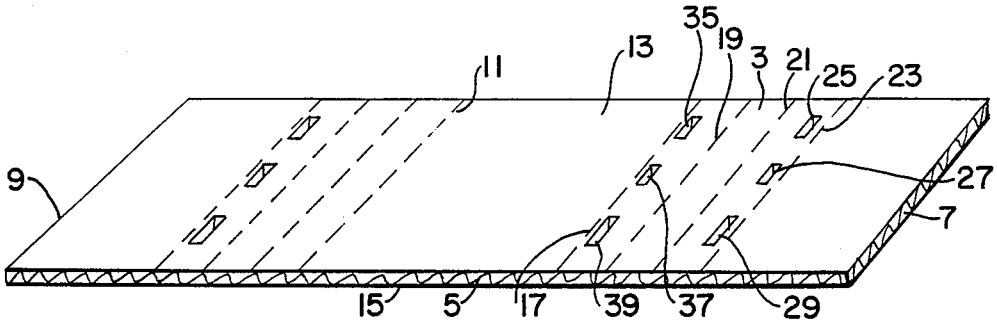
FIG. 1 illustrates a flattened, cut and scored continuous sheet base which is used to form the present invention pallet which is illustrated in a bottom oblique view in FIG. 2.
Figure 2:
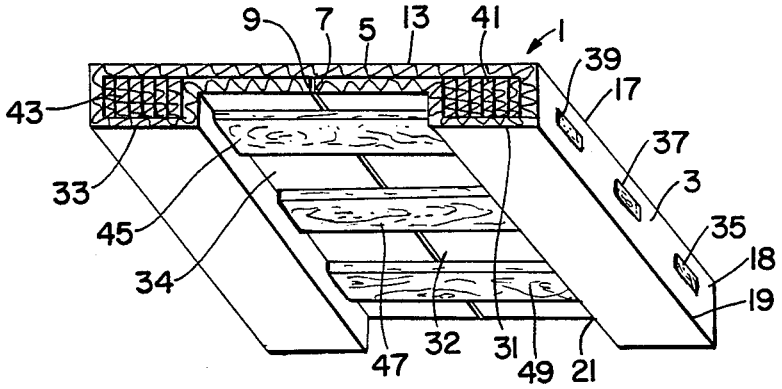

Referring now to FIGS. 1 and 2 collectively, it should be noted that like parts are like numbered and references are made herein to both drawings. Continuous sheet base 3 is used to form pallet 1 and contains, for example, nine slots which are typified by slots 25, 27, 29, 35, 37 and 39 at end 7. At opposite end 9, one set of slots is eliminated to create a "stop" when beams are inserted. Scores for folding are also made as are typified by fold creases or scores 17, 19, 21 and 23. The continuous sheet base 3 has a portion 11 which is a top rectangular portion which will include a top side 13 and an underside 15. Continuous sheet base 3 has side edges which are typified by side edge 5 and has ends 7 and 9 as shown. Cotinuous sheet base 3 is elongated as shown and has its ends folded repeatedly to form runner channels which are U-type runner channels 31 and 33 and also further folded to form undersupports 32 and 34.

Continuous sheet base 3 is thus folded downwardly at, for example, fold crease 17 at approximately a right angle to establish an outside vertical surface 18 and is then folded inwardly at approximately another right angle, this time, for example, at crease 19 to establish a bottom surface 20 and is then folded upwardly at approximately a right angle, for example, at crease 21 to establish an inside vertical surface (not shown), thus establishing parallel U-type runner channels such as runner channel 31. The continuous sheet base 3 is once again folded at approximately a right angle to establish flat ends which rest on the underside of top rectangular portion 11 to form undersupports such as undersupport 32. In this fashion, the slots are all alligned as shown and beams 45, 47 and 49 which are of a length approximately equal to the parallel length of top rectangular portion 11 are inserted into the slots after channel supports are first inserted. Thus, channel supports 41 and 43 are inserted into the U-type runner channels 31 and 33 and contain cutouts more specifically described in conjunction with FIGS. 3 thru 5 below, such that the cutouts are alligned with the slots such slots 35, 37 and 39. After the channel supports 41 and 43 are inserted, beams 45, 47 and 49 are then inserted at right angles to the channel supports and the U-type runner channels to hold undersupports 32 and 34 into place snugly and to retain the formation of the U-type runner channels 31 and 33 in a locked position as well as to secure channel supports 41 and 43 so that they cannot be removed from the U-type runner channel accidentally or intentionally until all of the beams are removed. Thus, a unique pallet being formed substantially of the continuous sheet base 3 is created in a collapsible form without the use of glue, fasteners, tape or stitches and may be easily disassembled by hand.

While continuous sheet base 3 is shown being made of corrugated paperboard or cardboard, it could also be made of plastic material, foldable laminated material or a combination of cellulosic and plastic materials without deviating from the intent or scope of the present invention. Likewise, the channel supports 41 and 43 in this case are accordian type channels of cut cardboard but could be made of any other available materials such as plastic, foam or the like and beams 45,47 and 49, while being made of wood, could easily be made of plastic or other synthetic material or even made of aluminum or sheet metal.

Figure 3:
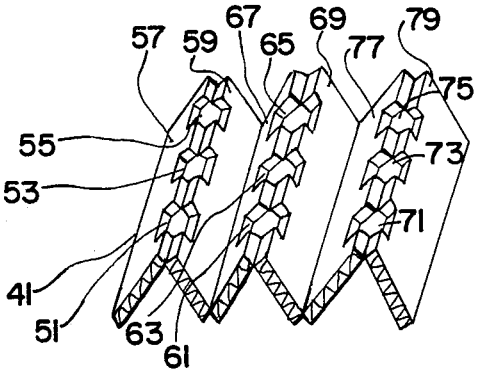
FIG. 3 illustrates an oblique view of a channel support which is spread apart for accordian type assembly.
Figure 4:
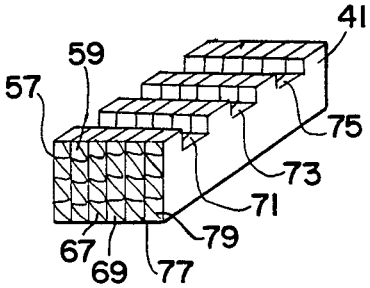
FIG. 4 illustrates the same device in its form ready to be inserted into a channel of a pallet of the present invention.

FIG. 3 shows a blown apart top oblique view of a channel support such as channel support 41 which has cuts and cut scores. Thus, panels 57, 59, 67, 69, 77 and 79 are established by alternatively cut scoring the top layer and then the bottom layer sequentially of a continuous piece of cardboard and folding same to create an accordian like strip. Cutouts 51, 53 and 55 are made in panels 57 and 59 and cutouts 61, 63 and 65 are made in panels 67 and 69 and cutouts 71, 73 and 75 are made in panels 77 and 79 so as to be totally alligned with one another, and when used in conjunction with the U-type runner channels of the present invention pallets and related products, will allign with the slots in the channel to allow the beams to be passed there through at right angles. FIG. 4 shows the same general support 41 in its closed or squeezed form, upside down, and this is readily inserted into a U-type runner channel of the present invention pallet to afford structural strength as well as to enhance locking of the beams with the channel.

FIG. 5 shows an alternative channel support 81 being made substantially of rigid urethane foam and having cutouts 83, 85 and 87.

FIG. 6 shows a supplemental base 89 which is used to be inserted on the underside of a typical present invention pallet to create one or more additional channels. Thus, while FIG. 6 illustrates only two channels, it should be recognized that this could be a strip having one, three or even more channels. Alternatively, a series of the FIG. 6 type single channel supplemental base could be used in conjunction with one another to increase the number of channels on a pallet of the present invention. Thus, supplemental base 89 has opposite ends 88 and 90 as well as side edges which are typified by edge 86. As can be seen, flat portion 91 is folded downwardly to form a vertical 97 and then folded again to form a bottom surface 99 and then folded upwardly to form another vertical surface 95 and folded yet again to form flat surface 93, resulting in U-type runner channel 80. U-type runner channel 82 is also shown and is a mirror image of U-type runner channel 80. All of the folds are at approximately 90° or right angles and the supplemental base 89 is slotted with slots as are typified by slots 92, 94 and 96. These slots are cut to be alligned with slots in other channels of a pallet with which supplemental base 89 may be used.

FIG. 7 shows a pallet of the present invention which employs the basic pallet design of FIG. 1 but within expanded width such that a supplemental base 289 is inserted into the middle and utilized accordingly. This is the same as supplemental base 89 shown in FIG. 6 but with only one channel instead of two channels. Thus, FIG. 7 shows present invention pallet 101 having end U-type runner channels 201 and 203 and this includes extended portions 205 and 207. A significant space is left between section 205 and 207 and it is in this space that supplemental base 289 with its channel 209 is inserted. All three channels, i.e. 201, 203 and 209 include channel supports and these are channel supports 311, 213 and 215 respectively. Also, as can be seen, beams 219, 221 and 223 are inserted at right angles to the channels, passing through the respective slots such as slots 225, 227 and 229 shown in conjunction with U-type runner channel 201.

Figure 9:
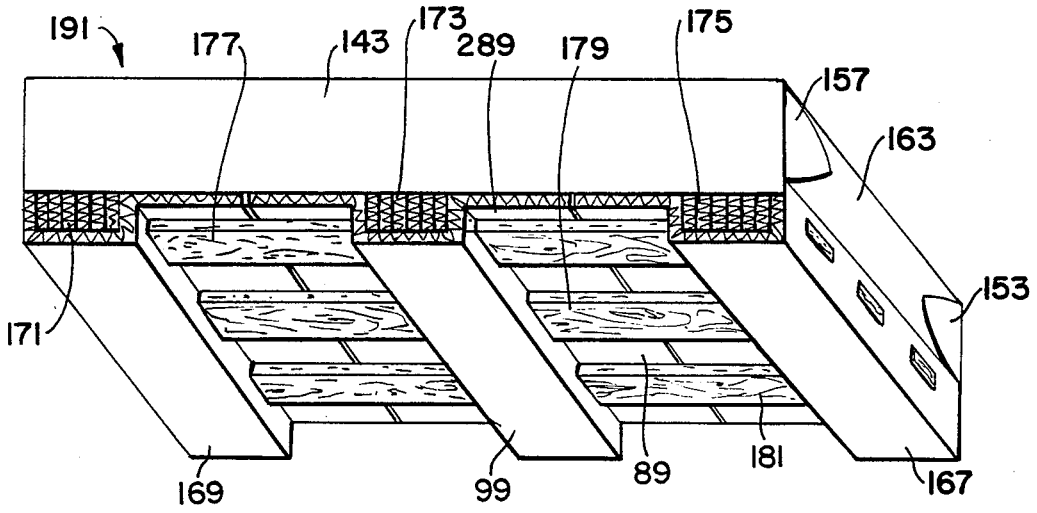
FIG. 9 shows the sheet of FIG. 8 used in conjunction with channel supports and beams to form a tray type container of the present invention.

FIG. 8 illustrates one portion of the stock material utilized to form a palletized tray of the present invention which is more fully illustrated in FIG. 9. Thus, FIG. 8 shows a continuous sheet base 103 which includes ends 107 and 109 which are basically folded under top rectangular portion 111 in the same fashion as ends 7 and 9 are folded as shown in FIGS. 1 and 2. The continuous sheet base 103 is scored and or creased for folding as is typified by folding creases 117, 119, 121 and 123. Continuous sheet base 103 also includes slots which are typified by slots 125, 127, 129, 135, 137 and 139. Tray side walls 141 and 143 are also shown and they have fold creases 145 and 147, respectively. They also include overlap flaps 151, 153, 155 and 157 and these are shown as illustrated specifically in FIG. 9 with respect to flaps 153 and 157 which may either be glued or stitched to insert panel 163. Again, referring to FIG. 8 and also now, to FIG. 9, note that the continuous sheet base 103 of FIG. 8 has its ends 107 and 109 appropriately folded under to form the end U-type runner channels 167 and 169 and that the very same supplemental base 96 shown in FIG. 6 is inserted in between. Thus, the palletized tray 191 of the present invention shown in FIG. 1 is made up of four separate cardboard or stock sheet material as well as the channel supports and the beams, i.e., palletized tray 191 includes continuous sheet base 103, a side panel 163 as well as another side panel (not shown), and supplemental base 289. Tray 191 further includes channel supports 171, 173 and 175 as well as beams 177, 179 and 181.

Figure 10:
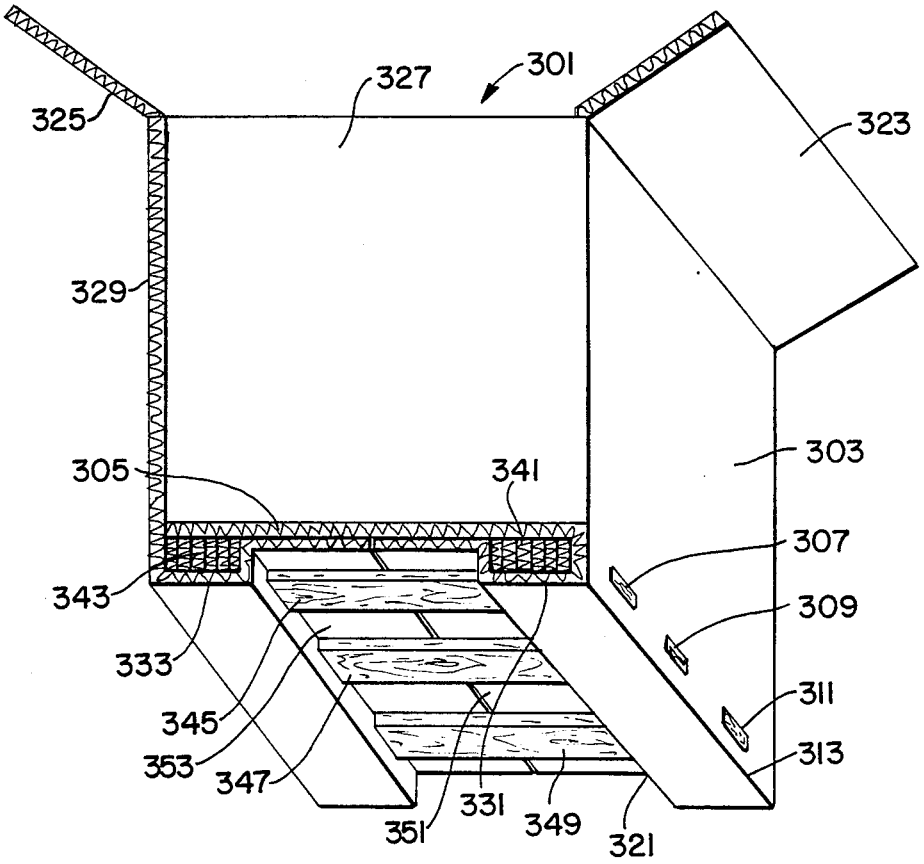
FIG. 10 shows a bottom oblique view of a palletized container of the present invention which may be used as a box and which includes extensions of sidewalls to form the unique pallet runner channels of the present invention.

Referring now to FIG. 10 there is a container 301 shown which is generally of the box type which may be used for moving, storage or any other type of containerized transportation or storage. Container 301 includes a main continuous sheet material 303 which runs from flap 323 downward to the base and is folded inwardly at approximately 90° at fold crease 313 and then upwardly at fold crease 321 to form U-type runner channel of 331 and then folded outwardly to form end flap 351. Main continuous sheet material 303 also is folded forwardly to include front panel 327 as shown. Additionally, main continuous sheet material 303 wraps around to the back of the container 301, which back is not shown, and then to the opposite side so as to include flap 325 and side section 329. Side section 329 continues downwardly and folds as shown to form U-type runner channel 333 and underside section 353. Channels 331 and 333 include channel supports 341 and 343 as shown. Additionally, there is shown on main continuous sheet material 303 slots 307, 309 and 311 which are representative of slots located in both sets of channels 331 and 333 identical to the slots decribed in conjunction with FIG. 1 above. Beams 345, 347 and 349 are inserted as shown to create structural integrety to container 301 in the same fashion as is achieved in the panels described in conjunction with the Figures above, except that in this case, container 301 is of fixed dimensions and has the pallet section as an integral part thereof. Bottom panel flap 305 is shown in exaggerated form to show it as a folded section off of the back wall, not shown, i.e. from a panel adjacent the channel-containing panels. The corner assembly of the vertical walls, i.e. the manufacturers joint, may be achieved by any known fashion such as stitching, taping, gluing or the like. Additionally, as with the other pallets and related products described above, the choice of sheet materials may vary, e.g. cardboard, corrugated paperboard, plastic, woven or non-woven, synthetic material, solid fiber paperboard or other material may be used. Also, the channel runner supports may be any of the above materials in composite form or molded form or may be foam or honeycomb or may be made of wood or plastic and may be solid, hollow or partially hollow as long as adequate structural support is achieved.

Figure 11:
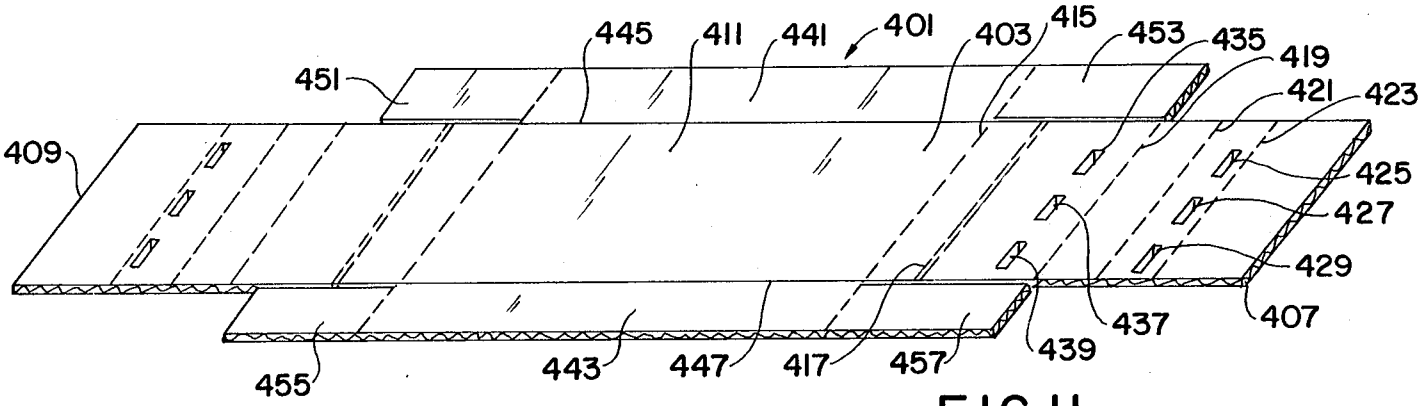
FIG. 11 shows an alternative tray pallet blank continuous sheet of the present invention; and, FIG. 12 shows an exploded view of the assembly of a pallet tray using the sheet shown in FIG. 11.
Figure 12:
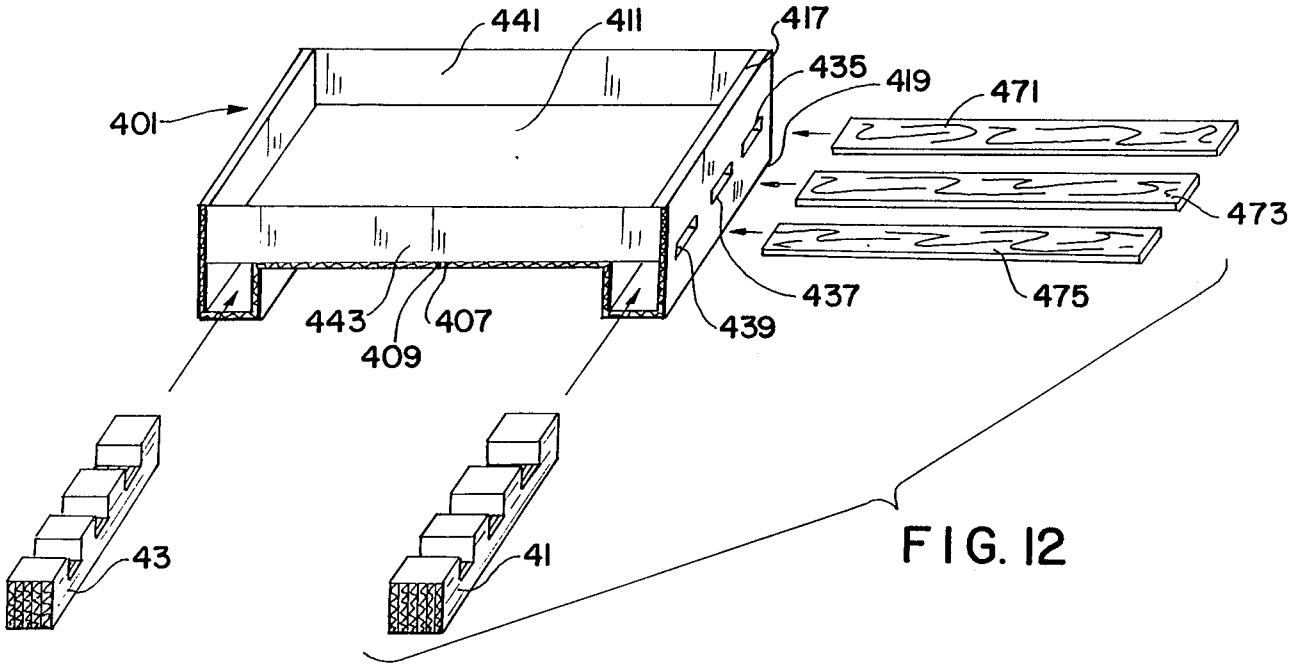

FIG. 11 illustrates sheet stock material utilized to form a palletized tray of the present invention which is more fully illustrated in FIG. 12. Thus, FIG. 8 shows a continuous sheet base 403 which includes ends 407 and 409 which are basically folded five times to form side walls and U-type support channels. For example, end 407 is folded upwardly at crease 415 and then folded downwardly at crease 415 with flaps 453 and 457 interleafed therebetween, then folded inwardly at crease 419, upwardly at crease 421 and inwardly at crease 423, as shown in FIG. 12.

Referring further to FIG. 12, tray side walls 441 and 443 are brought up and flaps 451, 453, 455 and 457 are interleafed, as shown. Channel supports 41 and 43 and then beams 471, 473 and 475 are inserted to create a finished palletized tray.

Obviously, numerous modifications and variations of the present invention are possible in light of the above teachings. It is therefore understood that within the scope of the appended claims, the invention may be practiced otherwise than as specifically described herein.

What is claimed is:

1. A pallet which comprises:

(a) an elongated continuous sheet base having side edges along its elongation and having two, opposite ends, said base having a top rectangular portion approximately centrally located said top rectangular portion having a topside and an underside, and having its ends folded, first, to form runner channels at each end, by being folded downwardly at approximately a right angle to establish an outside vertical surface, then being folded inwardly at approximately a right angle to establish a bottom surface, then being folded upwardly at approximately a right angle to establish an inside vertical surface, and to thereby form hollow, parallel U-type channels, and, second, to form undersupports, by being again folded at approximately a right angle to establish flat ends which act as undersupports and rest against the underside of said top rectangular portion, said U-type channels having a plurality of open slots aligned with one another in a straight line and at right angles to said U-type channels, said slots being closely located to said top rectangular portion;

(b) channel supports placed within the U-type channels, said supports being of adequate length, height and width to snugly fit within said U-type channels, said channel supports having cutouts of approximately equal dimensions to said slots and located to be coincidental therewith; and, (c) a plurality of beams being inserted into and running through said slots at approximately right angles to said U-type channels and running approximately the length of said top rectangular portion of said base.

2. The pallet of claim 1 wherein said base is constructed of corrugated paperboard.

3. The pallet of claim 1 wherein said channel supports are constructed of a series of corrugated paperboard panels connected in an accordian-like fashion.

4. The pallet of claim 1 wherein said base is constructed of plastic sheet material.

5. The pallet of claim 1 wherein said channel supports are constructed of rigid foam material.

6. The pallet of claim 1 wherein said channel supports are constructed of a rigid honeycomb structure.

7. The pallet of claim 1 wherein said beams are constructed of plastic.

8. The pallet of claim 1 wherein said beams are constructed of natural, cut or pressed wood.

9. The pallet of claim 1 which further comprises:

(d) a supplemental base having two sides and having two opposite ends, said supplemental base having flat horizontal portions placed directly under and against the underside of the top rectangular portion of the base, and having at least a portion thereof folded to form at least one runner channel, each such runner channel being formed by said base being folded downwardly at approximately a right angle to establish an outside vertical surface, then being folded inwardly at approximately a right angle to establish a bottom surface, then being folded upwardly at approximately a right angle to establish an inside vertical surface, and to thereby form a hollow, parallel U-type channel, each of said runner channels having a plurality of open slots aligned with one another in a straight line and at right angles to said channels, said slots being closely located to said flat horizontal portions, and further being aligned with the slots located in the runner channels of the base; and, (e) channel supports placed within the runner channels, said supports being of adequate length, height and width to snugly fit within said U-type channels, said channel supports having cutouts of approximately equal dimensions to said slots and located to be coincidental therewith.

10. The pallet of claim 9 wherein said supplemental base is constructed of corrugated paperboard.

11. The pallet of claim 9 wherein said channel supports are constructed of a series of corrugated paperboard panels connected in an accordian-like fashion.

12. The pallet of claim 9 wherein said supplemental base is constructed of plastic sheet material.

13. The pallet of claim 9 wherein said channel supports are constructed of rigid foam material.

14. The pallet of claim 9 wherein said channel supports are constructed of a rigid honeycomb structure.

15. The pallet of claim 1, further comprising a plurality of vertical wall panels connected to one another and to said base to form an integral container portion above the base.

16. A container, comprising:

(a) a plurality of vertical wall panels and a bottom panel connected to one another to form a container, and (b) bottom ends of two of said wall panels being extended below the bottom panel and folded to form opposite, parallel, runner channels, by being extended downwardly a predetermined length, then being folded inwardly at approxiamately a right angle to establish a bottom surface, then being folded upwardly at approximately a right angle to establish an inside vertical surface, and to thereby form hollow, parallel U-type channels, and, second, to form undersupports, by being again folded at approximately a right angle to establish flat ends which act as undersupports and rest against the underside of said bottom panel, said U-type channels having a plurality of open slots aligned with one another in a straight line and at right angles to said U-type channels, said slots being closely located to said bottom panel;

(c) channel supports placed within the U-type channels, said supports being of adequate length, height and width to snugly fit within said U-type channels, said channel supports having cut outs of approximately equal dimensions to said slots and located to be coincidental therewith; and, (d) a plurality of beams being inserted into and running through said slots at approximately right angles to said U-type channels and running approximately the length of said bottom panel.

17. The container of claim 16 wherein said panels are constructed of corrugated paperboard.

18. The container of claim 16 wherein said channel supports are constructed of a series of corrugated paperboard panels connected in an accordian-like fashion.

19. The container of claim 16 wherein said panels are constructed of plastic sheet material.

20. The container of claim 16 wherein said channel supports are constructed of rigid foam material.

21. The container of claim 16 wherein said channel supports are constructed of a rigid honeycomb structure.

22. The container of claim 16 wherein said beams are constructed of plastic.

23. The container of claim 16 wherein said beams are constructed of natural, cut or pressed wood.

24. A container, comprising:

(a) a plurality of vertical wall panels and a bottom panel having a horizontal base, said panels being connected to one another to form a container, and (b) said bottom panel being of extended length to form side wall supports and to form opposite, parallel, runner channels, by first being upwardly a predetermined height above the horizontal base and then 180° downwardly to and past the horizontal base to form side wall supports and then extended further downwardly a predetermined length, then being folded inwardly at approximately a right angle to establish a bottom surface, then being folded upwardly at approximately a right angle to establish and inside vertical surface, and to thereby form hollow, parallel U-type channels, and, next to form undersupports, by being again folded at approximately a right angle to establish flat ends which act as undersupports and rest against the underside of said horizontal base of the bottom panel, said U-type channels having a plurality of open slots aligned with one another in a straight line and at right angles to said U-type channels, said slots being closely located to said horizontal base of the bottom panel;

(c) channel supports placed within the U-type channels, said supports being of adequate length, height and width to snugly fit within said U-type channels, said channel supports having cut outs of approximately equal dimensions to said slots and located to be coincidental therewith; and, (d) a plurality of beams being inserted into and running through said slots at approximately right angles to said U-type channels and running approximately the length of said horizontal base of the bottom panel.

25. The container of claim 24 wherein said panels are constructed of corrugated paperboard.

26. The container of claim 24 wherein said channel supports are constructed of a series of corrugated paperboard connected in an accordian-like fashion.

27. The container of claim 24 wherein said channel supports are constructed of rigid foam material.

28. The container of claim 24 wherein said channel supports are constructed of a rigid honeycomb structure.

29. The container of claim 24 wherein said beams are constructed of plastic.

30. The container of claim 24 wherein said beams are constructed of natural, cut or pressed wood.

* * * * *